United States Patent [19]

Wolff et al.

[11] Patent Number: 5,069,350

[45] Date of Patent: Dec. 3, 1991

[54] BACKSPLASH SYSTEM

[75] Inventors: Robert A. Wolff, Middleburg; John F. Troxell, Jr., Northumberland, Pa.

[73] Assignee: Wood-Mode, Incorporated, Kreamer, Pa.

[21] Appl. No.: 442,029

[22] Filed: Nov. 28, 1989

[51] Int. Cl.[5] ..... A47F 5/08

[52] U.S. Cl. ..... 211/87; 211/119; 211/186; 211/175

[58] Field of Search ..... 211/87, 6, 16, 106, 211/105.1, 204, 119, 123, 189, 206, 113, 94.5, 94, 124, 119, 181, 186, 134, 175; 248/301, 340, 303

[56] References Cited

U.S. PATENT DOCUMENTS

| | | | |
|---|---|---|---|
| 2,024,892 | 12/1935 | Soper | 211/87 X |
| 2,176,644 | 10/1939 | Sladek | 248/544 X |
| 2,956,689 | 10/1960 | Van Der Togt | 211/106 X |
| 3,391,891 | 7/1968 | Garden | 211/181 X |
| 4,269,381 | 5/1981 | Harms | 248/225.1 X |
| 4,712,692 | 12/1987 | Peinsipp | 211/181 X |
| 4,946,049 | 8/1990 | Silverberg | 211/94 X |

OTHER PUBLICATIONS

M. G. Milo, Supporting Rack for Circuit Boards During Electroplating, Oct. 1970, pp. 51–52.

*Primary Examiner*—Blair M. Johnson
*Assistant Examiner*—Korie H. Chan
*Attorney, Agent, or Firm*—Caesar, Rivise, Bernstein, Cohen & Pokotilow, Ltd.

[57] ABSTRACT

A system adapted to support items normally used in the kitchen, with the system being mounted on a backsplash wall. The system comprises a rail tube and mounting sleeves for supporting the rail tube on the wall. The rail tube is square in cross-section, and is mounted with a corner of the square being uppermost. Various supporting members are suspended from the rail tube, with the supporting members having an upper loop of the same square configuration as the rail tube. One supporting member suspendable from the rail tube is a paper towel holder having a horizontally extending frame. Two sides of the frame have a swaged area, and a hollow tube, having spaced notches, is mounted on the frame by placing the notches over the swaged areas. A roll of paper towels is supported by the tube. Another structure suspended from the rail tube is a rack that includes a shelf. The shelf can be mounted horizontally to serve the function of a cooling rack, and can be mounted at a slight angle, to serve the function of a cookbook holder. A lip prevents the cookbook from sliding off the shelf.

10 Claims, 5 Drawing Sheets

FIG. 2
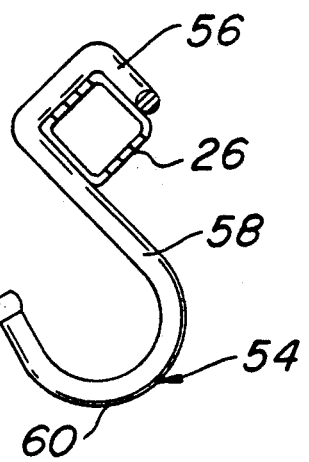
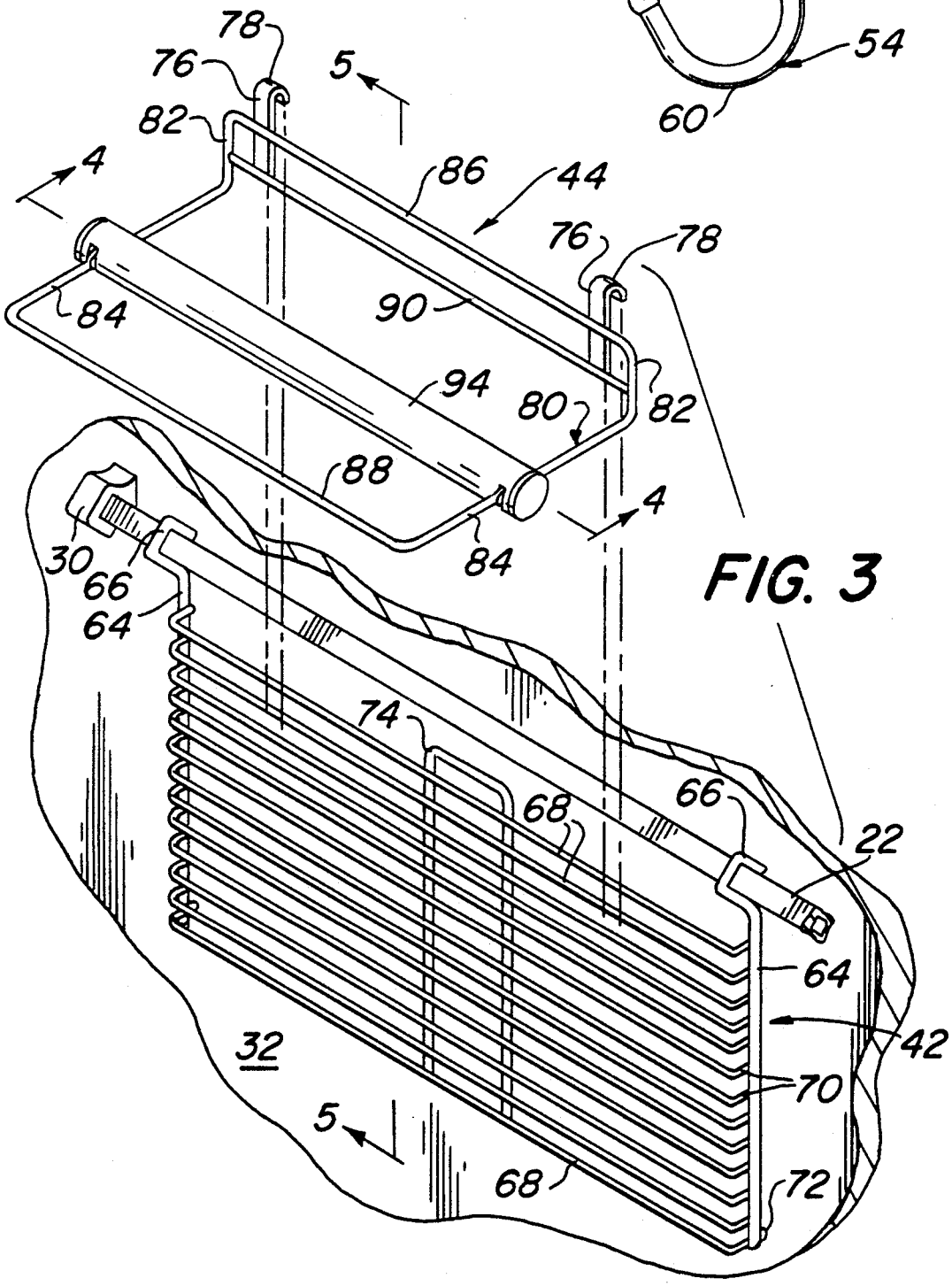
FIG. 3

FIG. 4
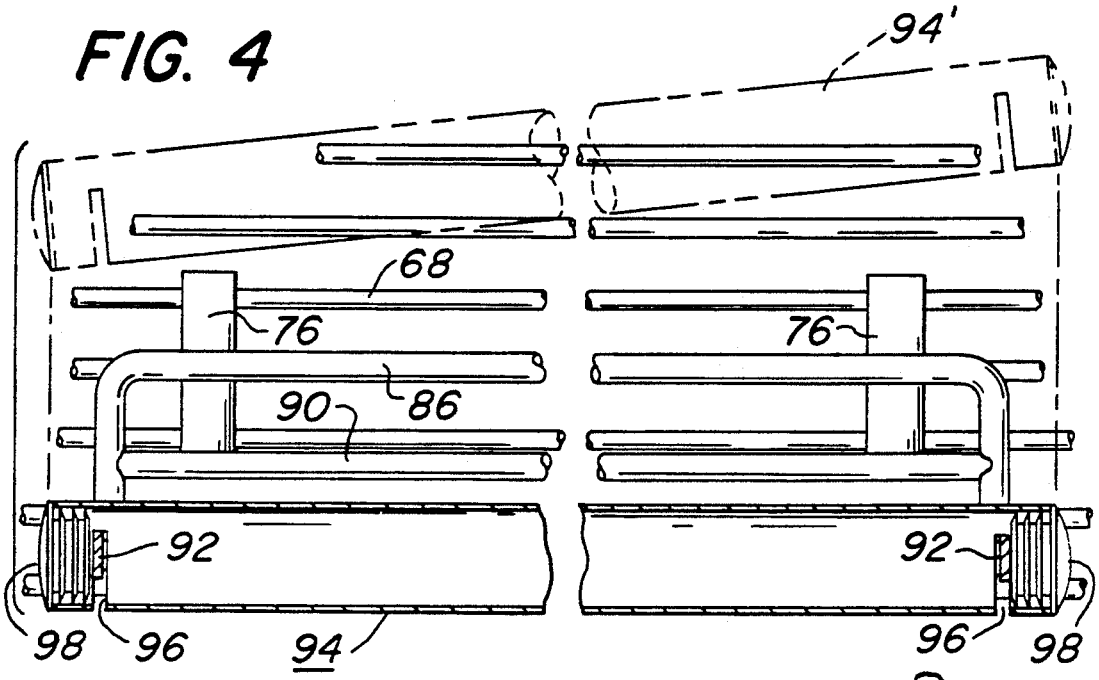
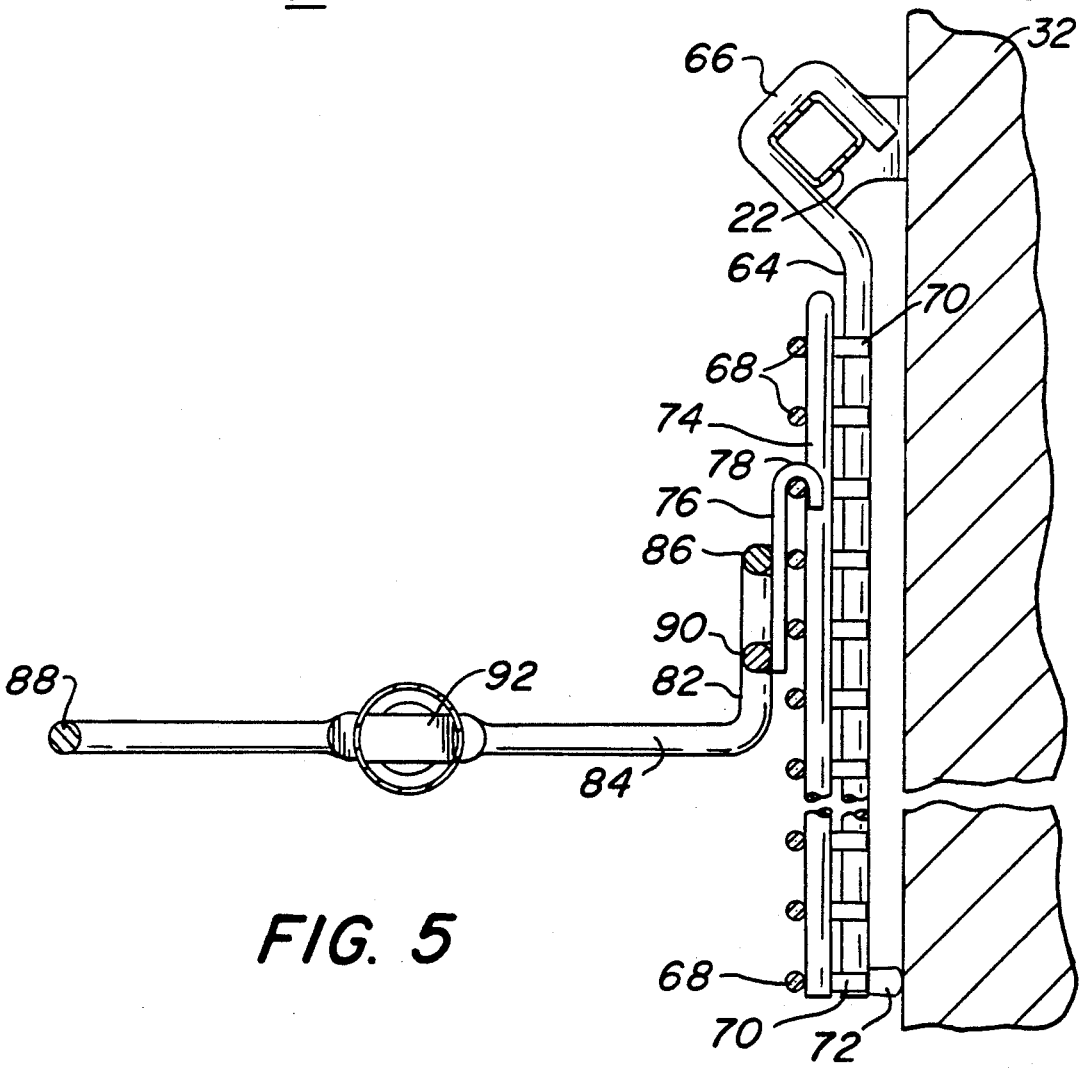
FIG. 5

FIG. 7
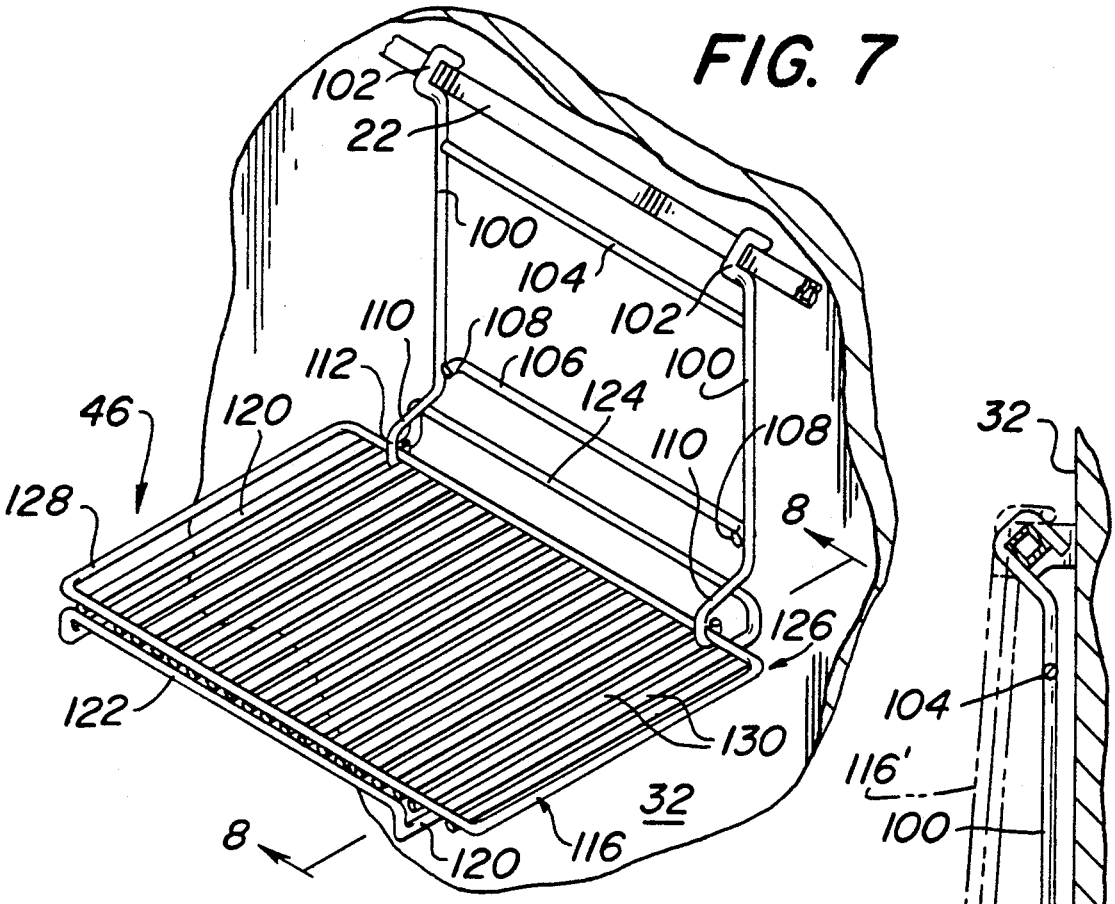
FIG. 8
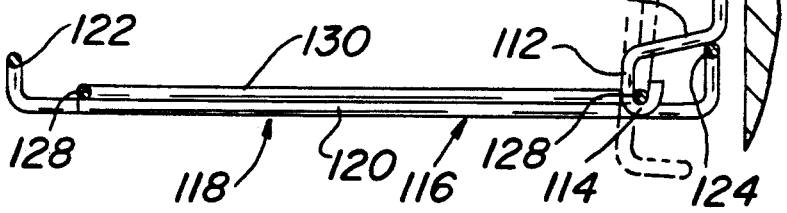
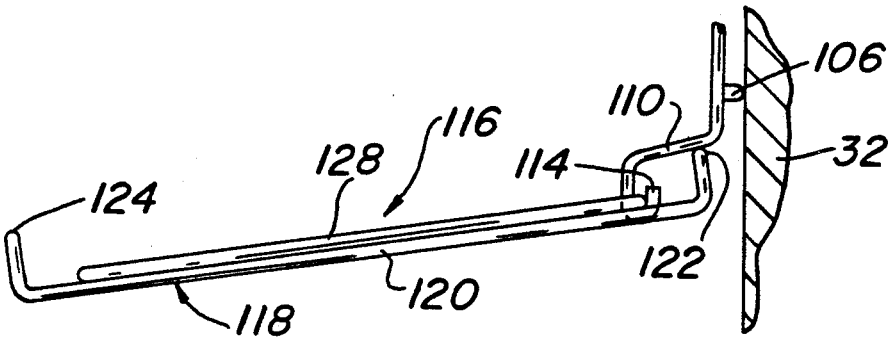
FIG. 9

BACKSPLASH SYSTEM

BACKGROUND OF THE INVENTION

This invention relates to a backsplash system, in general, and, more particulary, to a system for supporting kitchen utensils, cooking utensils, cookbooks, paper towels and other materials generally used in the kitchen, on the backsplash area behind a countertop.

In recent years, grater use has been made of the backsplash area located in the rear of a kitchen countertop and below the kitchen cabinets. Various fixtures, such as paper towel dispensers, have been built into the backsplash wall. Additionally, various fixtures have been secured to the backsplash wall for suspending cooking utensils, such as spoons, ladles, spatulas, etc.

In recent years, greater use of the backsplash wall has been made by the securement of a rail to the backsplash wall. The rail is tubular, and circular in cross-section. Various pieces of supporting hardware can then be suspended from the rail. The supporting hardware can include paper towel holders, shelves, spice racks, utensil holders and hooks, from which cooking utensils can be suspended. All of these items that are suspended from the rail have an upper loop which is semi-circular at its top, and which can be looped over the rail. The loops can then be slid along the rail to any desired position.

One of the shortcomings of this type of system is that the suspended hardware is freely rotatable around the loop, which results in the suspended items banging into the wall. Additionally, because of the free rotation of the suspended hardware, and especially the suspended hooks, positioning an item on the hardware or hook is difficult, in view of the free rotation. Thus, in view of the free-swinging hooks, a user may have to "fish" for the hook in order to hang a utensil.

One of the features of the backsplash system of this invention is that the rail support forming a part of the system has a square cross-section, with one of the corners of the square being uppermost. The loop used for suspending hooks or other kitchen hardware in this invention has a square mating configuration that matches the cross-section of the tube. Accordingly, when the hook is placed over the tube, it is positively associated to the tube at any desired location, while still being capable of sliding or repositioning. Since the suspended hook or hardware is not rotatable about the rail, there will be no marking of the backsplash area wall when a utensil is suspended from a hook or any other object is placed in any of the other suspended hardware. Additionally, having the positively positioned, suspended hooks permits the easy securement of kitchen utensils to the hooks, without the objectionable rotation of the hooks of the present systems.

Another feature of this invention is the provision of grill racks, which are suspended from the rail. Once the grill rack is in place, various other kitchen hardware can then be secured to the rack. This permits greater utilization of the full surface of the backsplash wall. Although various grill racks have been developed in the past, they were permanently secured to the backsplash area. Utilizing the grill racks of this invention, they are releasably secured to the rail, and can easily be moved or removed, without marring the surface of the backsplash wall.

In another aspect of this invention, a novel paper towel holder is provided, for suspension from one of the grill racks. The paper towel holder can easily be hung at any height on a grill rack, and can easily be repositioned. It is adapted to hold both standard and jumbo sized rolls of paper towels, and the rolls are freely rotatable about a supporting tube. There is also a tear bar for easily removing individual sheets from the roll of paper towels.

In the other backsplash systems in use prior to this invention, where a paper towel holder was provided, it consisted simply of a suspended basket, in which the roll of paper towels was placed. The roll could not rotate around a shaft, since none was provided, and there was no bar for tearing individual sheets from the roll.

Another feature of this invention is the provision of a rack adapted to serve the dual function of being a cookbook holder and a cooling rack for cooked foods. Although cookbook holders have been in use in other backsplash systems, they were of a structure wherein they could be used only for holding cookbooks. Thus, when suspended from the rail, the only position they could maintain was that of being angled vertically downward, to support a cookbook. There was no method of adjusting the rack to have it in a horizontal position, whereby it could serve as a cooling rack. When not in use, the rack of this invention is rotatable to a stored, vertical position, thereby avoiding encumbering any counter space.

OBJECTS OF THE INVENTION

Accordingly, it is a general object of this invention to provide a novel backsplash system that is mountable on the backsplash wall of a kitchen.

It is another object of this invention to provide a novel rail and suspension system mountable on a backsplash wall of a kitchen.

It is a further object of this invention to provide a novel paper towel holder.

It is yet a further object of this invention to provide a novel rack that serves the dual function of being a cookbook holder and cooling rack.

SUMMARY OF THE INVENTION

These and other objects of the invention are accomplished by providing a system adapted to support items normally used in the kitchen, said system being mountable on a backsplash wall. The system comprises a rail tube and mounting sleeves for supporting the rail tube on the wall. The rail tube is square in cross-section, and various supporting members are adapted to be suspended from the rail tube. Each of the supporting members has an upper loop, of the same square configuration as the rail tube, but open at the bottom and accordingly, when the loop is placed over the rail tube, there will be no rotational movement of the supporting member relative to the rail tube.

The invention further encompasses a paper towel holder that is suspended, either directly or indirectly, from the rail tube. The paper towel holder includes suspending bars with upper loops, and a horizontally extending U-shaped frame. The frame has parallel sides, and a swaged area on each side. A hollow tube, having spaced notches, is mounted on the frame by placing the notches over the swaged areas, thereby securing the tube in place. A roll of paper towels is mountable on the tube.

The invention further encompasses a rack to be suspended directly or indirectly from the rail tube. The rack includes a wire grid and a frame having an upwardly projecting lip at each end. The lip at one end is slightly shorter than the lip at the other end. When the shorter lip is positioned rearwardly relative to a suspending member, the rack tilts downwardly, and serves the function of a cookbook holder. When the longer lip is positioned rearwardly, the rack extends horizontally, and serves the function of a cooling rack.

DESCRIPTION OF THE DRAWINGS

Other objects and many of the attendant advantages of this invention will be readily appreciated as the same becomes better understood by reference to the following description when considered in connection with the accompanying drawings, wherein:

FIG. 2 is an enlarged sectional view taken along the line 2—2 of FIG. 1;

FIG. 3 is an exploded perspective view showing the paper towel holder of this invention and the suspended grill rack on which it is to be mounted;

FIG. 4 is an enlarged sectional view, partially in phantom, taken along the line 4—4 of FIG. 3;

FIG. 5 is an enlarged sectional view taken along the line 5—5 of FIG. 3, and showing the paper towel holder, as mounted on the grill rack;

FIG. 7 is a perspective view showing a rack adapted to serve as a cooling rack;

FIG. 8 is an enlarged sectional view taken along the line 8—8 of FIG. 7;

FIG. 9 is a partial sectional view of the rack shown in FIG. 7, but in its position of being a cookbook holder;

DETAILED DESCRIPTION OF THE PREFERRED EMBODIMENT

Figure 1:
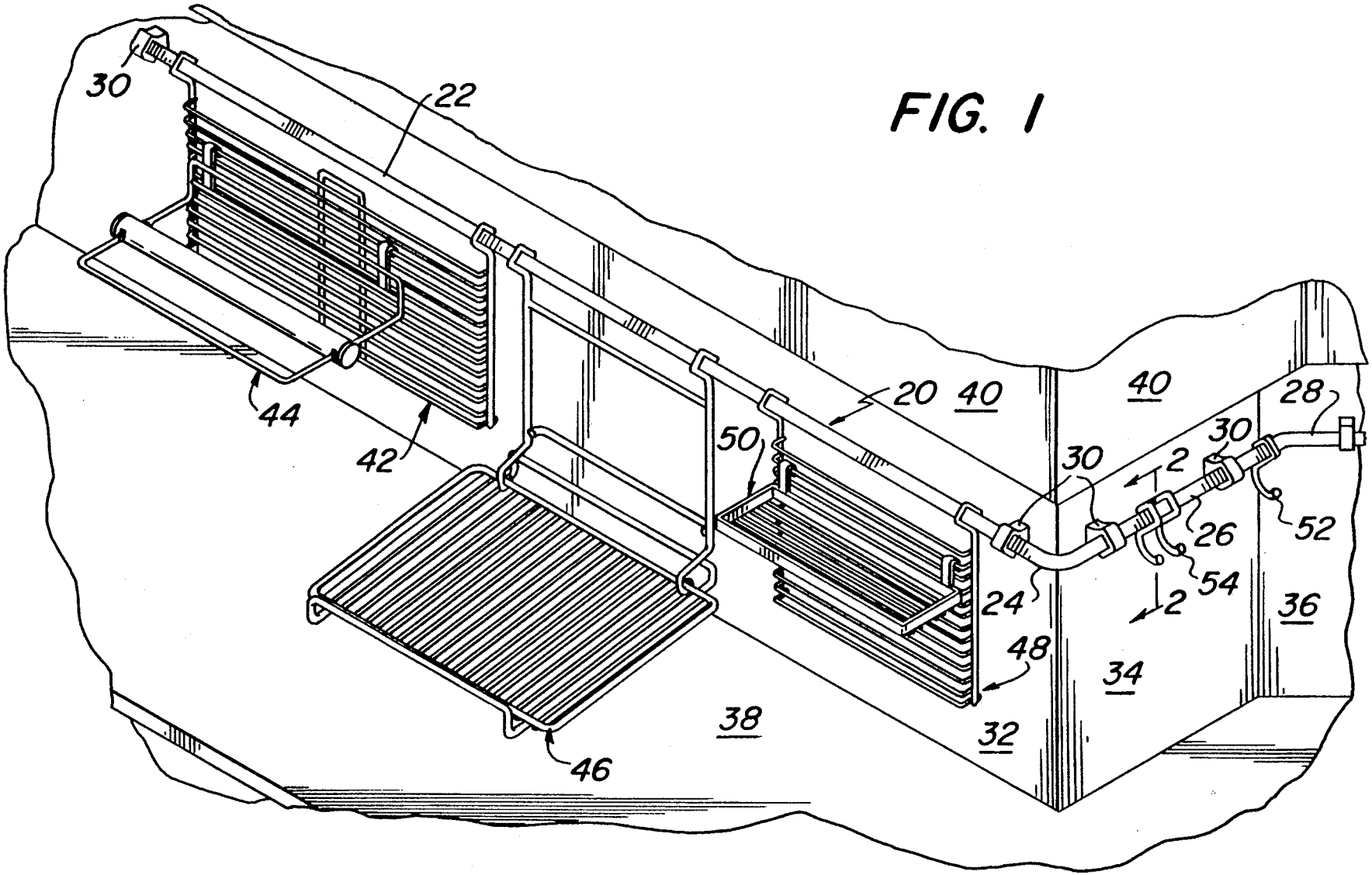
FIG. 1 is a perspective view showing the backsplash system of this invention, as mounted on a backsplash wall.

Referring now in greater detail to the various figures of the drawing, wherein like reference characters refer to like parts, a backsplash system embodying the present invention is generally shown at 20 in FIG. 1. Device 20 comprises a plurality of rail tube sections 22, 24, 26 and 28 and mounting sleeves 30. The system is mounted on backsplash walls 32, 34 and 36. The backsplash walls project upwardly from the rear of countertop 38 and are positioned beneath kitchen cabinets, which are shown schematically at 40.

Suspended from the rail tube sections 22 to 28 are various items of supporting hardware for use in the kitchen. As will be explained in greater detail hereinafter, the suspended hardware includes a grill rack 42, a paper towel holder 44, a rack 46 that serves the functions of being a cookbook holder and cooling rack, a second, and smaller, grill rack 48 and a shelf 50. Also suspended from the rail tube sections are a single hook 52 and a double hook 54.

Referring now to FIG. 2, it is seen that each rail tube section (section 26 shown in FIG. 2) is square in cross-section, and is mounted on the backsplash wall with a corner of the square being uppermost, thereby assuming a diamond shape. Each hook (both the single hook 52 and the double hook 54) has a loop 56 that is U-shaped, and can be slipped over a rail tube 26. When so positioned, as seen in FIG. 2, the two upper faces of the rail tube and the forward lower face of the rail tube are contacted by the legs of the loop 56. The rearward facing lower face of the rail tube remains uncovered, and the hook 54 can easily be slipped on and off the rail tube. The forward leg 58 of the loop 56 terminates in an arcuate loop 60, having a protected plastic end cap 62.

The hooks 52 and 54 are used in the same manner as the prior art hooks mounted on backsplash rails. Thus, various kitchen utensils, such as serving spoons, ladles, spatulas, etc., can be suspended from the hooks. However, in the prior art, the hooks were suspended from rounded rails, and it required two hands to mount a kitchen utensil, with one hand holding the hook in place and the other hand placing the utensil in place. Utilizing the square rail tube with the associated square loop of the hook, of this invention, the hook retains its position, and it is easy to slip any kitchen utensil over the hook, with one hand. This rigid mounting of the hook also facilitates the removal of a utensil from the hook.

Referring now to FIGS. 3, 4 and 5, the grill rack 42 and paper towel holder 44 are shown in detail therein. The grill rack 42 comprises a pair of spaced rods 64, with each rod having an upper U-shaped loop 66, adapted to be slid over rail tube section 22. With the loop 66 in place, as seen- in FIGS. 3 and 5, the rods 64 project vertically downward, and parallel to the backsplash wall 32. A plurality of parallel wire rods 68, having end flanges 70, are welded to rods 64. As seen in FIGS. 3 and 5, the rods 68 are welded in a horizontal, spaced relationship. The lowermost flanges 70 (FIG. 5) extend beyond the rear of rods 64, and rubber tips 72 are secured thereon. As seen in FIG. 5, the rubber tips aid in maintaining the vertical alignment of the rods 64, and in maintaining the position of the grill rack 42 parallel to the backsplash wall. A U-shaped reinforcing rod 74 is welded to the rear faces of the wire rods 68.

The grill rack 42 supports the paper towel holder 44. The paper towel holder 44 includes a pair of spaced bars 76 having upper loops 78. The bars 76 are welded to frame 80. Frame 80 includes vertical legs 82, legs 84 projecting horizontally therefrom and bridging legs 86 and 88. A reinforcing leg 90 is parallel to leg 86, and is welded to legs 82. Bars 76 are in turn welded to legs 86 and 90. Legs 84 are swaged at their midpoints to form flattened sections 92 (FIGS. 4 and 5). With the exception of the flattened sections, the legs 84, as is the balance of the frame 80, are circular in cross-section.

The paper towel holder further includes a tube 94. The underside of the tube 94 is provided with vertically extending slots 96 (FIG. 4), which slots are spaced the same distance as the flattened sections 92. A plug 98, having a rounded outer surface, is inserted in each end of tube 94, and terminates at the slot 96. When the paper towel holder 44 is assembled, with a roll of paper towels in place, the tube 94 is mounted on the legs 84, by the engagement of the flattened sections 92 in slots 96.

In order to mount the paper towel holder for use, the loops 78 of bars 76 are placed over one of the horizontal wire rods 68. As seen in FIG. 5, this suspends the paper towel holder in a position wherein the legs 84 project horizontally outward from the wall 32. In order to place a roll of paper towels on the holder, the tube 94 is lifted vertically, as indicated at 94' in FIG. 4. The tube 94 is then inserted through the tube in the roll of paper towels, and the paper towel roll and tube are then lowered to the position shown at 94 in FIG. 4. At this point, the paper towel roll is freely rotatable around the tube 94. Whenever it is desired to remove one or more sheets of paper towels from the roll, the leading sheet is passed under the bridging leg 88 (FIG. 3), and is pulled upwardly, thereby severing the sheet along a perforation line.

Referring now to FIGS. 7, 8 and 9, the rack 46, which serves the dual function of being a cookbook holder and cooling rack, is shown. The rack includes a pair of spaced rods 100 having upper U-shaped loops 102. The loops 102 are adapted to pass over, and be supported by, rail tube section 22. A reinforcing rod 104 is welded to rods 100. A second reinforcing rod 106 is secured to rods 100 by forwardly projecting flanges 108. As seen in FIG. 8, rod 106 is positioned behind rods 100, and in the mounted position of the rack 46, the rod 106 rests against backsplash wall 32.

The lower ends of rods 100 include forwardly and downwardly projecting legs 110, vertically projecting legs 112 and U-shaped loops 114.

The rack 46 further includes a shelf 116. The shelf includes a supporting frame 118 consisting of spaced side legs 120, a forward leg 122, and a rear leg 124. Legs 122 and 124 are both elevated above legs 120, thereby forming front and rear lips. As seen in FIG. 8, the lip formed by forward leg 122 is shorter than the lip formed by rear leg 124.

A grid 126 overlies frame 118 and is welded thereto. Grid 126 is formed from a rectangular perimeter rod 128 and parallel wire rods 130 welded thereto. The grid 126 is in turn welded to frame 118.

When the rack 46 is intended to be used as a cooling rack, it is in the position shown in FIGS. 7 and 8. Thus, the shelf 116 projects horizontally from rods 100. In order to accomplish this, perimeter rod 118 is placed within loops 114, thereby supporting the shelf 116. The weight of the shelf rotates the shelf around rod 128 in a counterclockwise direction, as viewed in FIG. 8. This brings the rear leg 124 into abutment with the underside of the angled legs 110, thereby maintaining the horizontal position of the shelf 116.

With the rack 46 in the position shown in FIGS. 7 and 8, the rack serves as a cooling rack. Accordingly, pots, pans, hot dishes, etc. can be placed on the rack, and they will cool more readily than they would if they were positioned directly on a countertop. Thus, air will circulate around the container for the food, which enhances the cooling function. Additionally, by elevating the food in this manner, there is no fear of marring the countertop surface, as there might be by placing a hot pot directly on, or close to, the countertop.

When the rack 46 is to be used as a cookbook holder, it is lifted from loops 114, and rotated 180 degrees, in a horizontal plane. This results in the leg 122 being rearmost. Additionally, the lip formed with leg 122 is shorter than the lip formed with leg 124, and accordingly when the leg 122 contacts the underside of inclined leg 110, the shelf 116 will project downwardly. In the embodiment shown, the angle of downward projection is 10 degrees.

With the shelf. 116 in the position shown in FIG. 9, a cookbook can be placed on the shelf, and will be prevented from sliding off the shelf by the lip formed by forward leg 124. Having the cookbook holder removes the cookbook from the countertop surface, thereby retaining needed space. The location of the shelf is far enough below the cabinets so as not to obstruct viewing. The 10 degree angle aids in viewing the cookbook.

When the shelf 116 is not going to be used as either a cooling rack or a cookbook holder, it can easily be folded for storage. Thus, the shelf 116 can be rotated to the position shown in phantom at 116' in FIG. 8, and will be maintained in that position by the engagement of the tops of loops 102 in the loop formed by the lip including leg 122. When it is desired to use the shelf as a cooling rack or cookbook holder, all that need be done is to engage rod 128 within loop 114, in the manner described above. With the shelf in the position shown at 116', the availability of countertop surface is enhanced.

Figure 6:
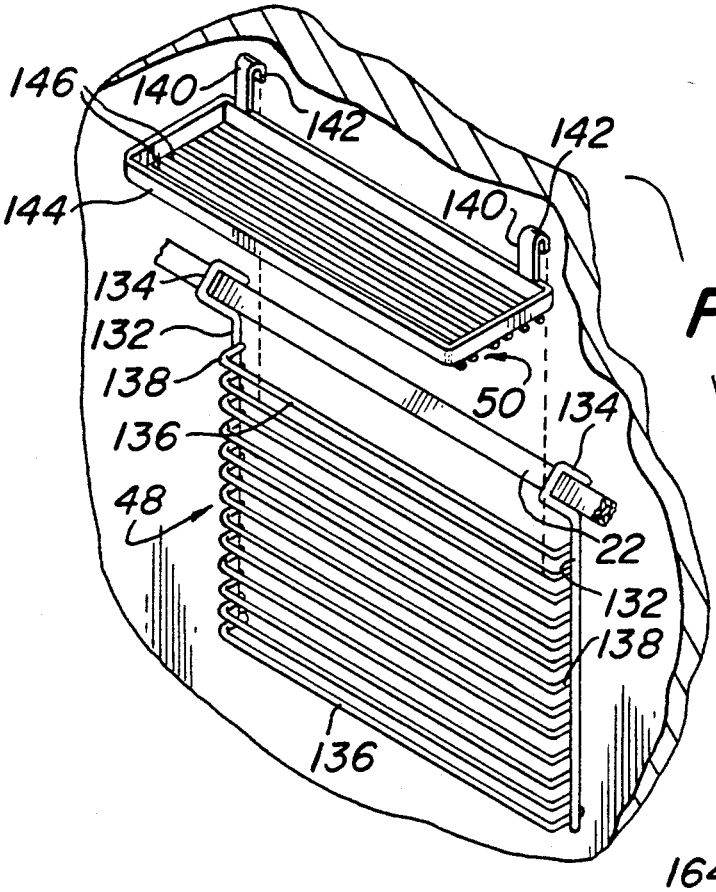
FIG. 6 is an exploded perspective view showing a shelf and a grill rack on which it is to be mounted.

Referring now to FIG. 6, the grill rack 48 shown therein is similar in structure to grill rack 42, but is smaller in size. Grill rack 48 includes a pair of spaced rods 132 having upper U-shaped loops 134. Loops 134 are engaged over rail tube section 22. The grill rack further includes a plurality of spaced, horizontally extending wire rods 136 which are secured to rods 132 by end flanges 138. The grill rack 48 is the same in structure as grill rack 42, but because of its smaller size, it does not require a reinforcing rod similar to rod 74.

When the grill rack 48 is mounted on a rail tube, it can be used for supporting various other items of kitchen hardware. This can include a spice rack, a small utensil holder, a wire basket, a shelf, etc. By way of example, a shelf 50 is shown in FIGS. 1 and 6.

Shelf 50 includes a pair of bars 140 having upper loops 142. The bars are secured to a rectangular frame 144, and a plurality of spaced rods 146 are welded to the frame 144, thereby forming a horizontal shelf. The shelf can then be suspended from any of the wire rods 136 by the engagement of loops 142, as seen in FIG. 1 Various items usable in a kitchen can then be placed on the shelf 50.

Figure 10:
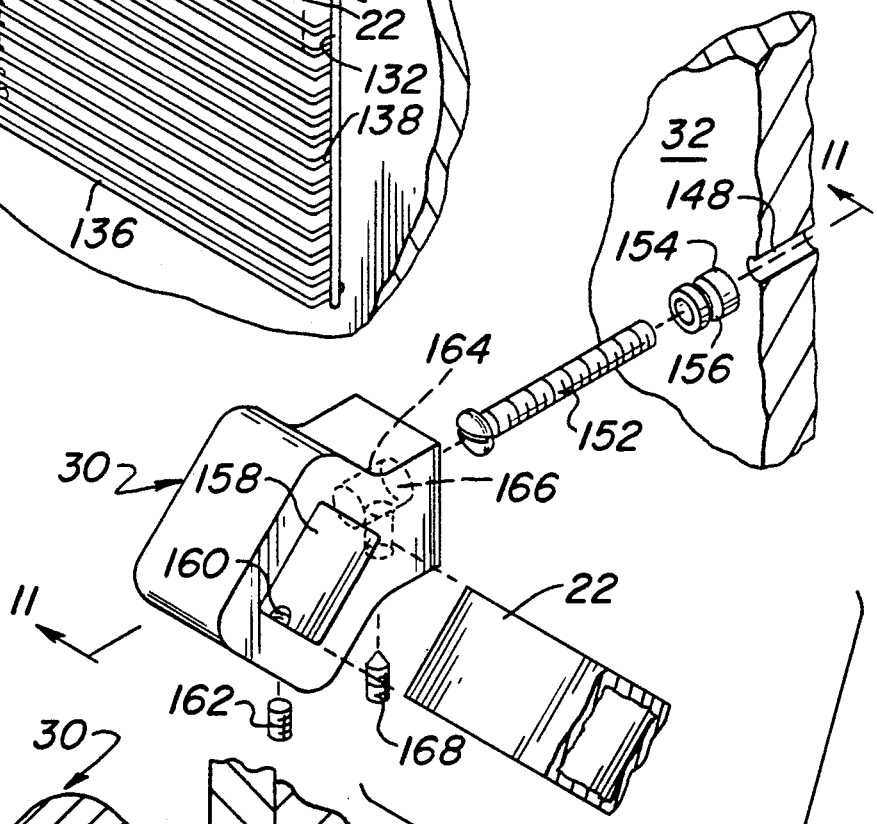
FIG. 10 is an exploded view, partially in section, showing the elements used in mounting the rail tube on a backsplash wall.
Figure 11:
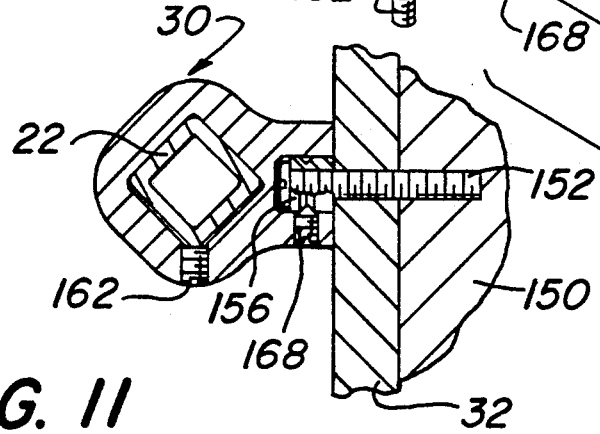
FIG. 11 is a sectional view taken along the line 11—11 of FIG. 10, and showing the rail tube, as mounted on a backsplash wall.

Turning now to FIGS. 10 and 11, the manner of securing the rail tube sections to the backsplash wall is shown. The rail tube sections are held in place against the wall by a plurality of mounting sleeves 30. When the positioning of the mounting sleeves is determined, a hole 148 is drilled in the wall. If the mounting will be on studs, such as stud 150, the hole 148 will be drilled through the wall and into the stud. If it is inconvenient to use studs, then any of the known forms of screw anchors or toggle bolts can be used.

After the appropriate holes 148 are drilled, a bolt 152 is passed through a sleeve 154, and threadedly secured in wall 32 and stud 150. Sleeve 154 includes an annular groove 156.

Mounting sleeve 30 is formed from a casting, and includes an opening 158 passing therethrough. The opening 158 has a square cross-section, and is positioned with one of the corners of the square being uppermost, thereby forming a diamond shape. At the base of the diamond-shaped opening, there is a threaded bore 160, in which a set screw 162 is threadedly secured. A horizontal bore 164 is formed in the rear face of mounting sleeve 30 and a second threaded bore 166 projects into horizontal bore 164, from the bottom of mounting sleeve 30. A set screw 168 is threadedly received in bore 166.

In assembling the rail tubes on the wall, one end of a rail tube 22 is inserted in the opening 158 of sleeve 30. The rail tube is then secured in place by tightening set screw 162, as shown in FIG. 11. The sleeve 30 is then positioned against the wall 32 by sliding the sleeve over sleeve 154, thereby positioning the sleeve 154 in horizontal bore 164. The sleeve 30 is then secured on the wall by tightening set screw 168, until its tip enters annular groove 156.

Other mounting sleeves 30 are secured on the wall in the same manner, thereby providing a continuous length of rail tube sections, as shown in FIG. 1. The rail tube sections can be of any length, and can have right angles, such as shown at 24, or obtuse angles, such as shown at 28. Various other angles can be formed, in order to accommodate any particular backsplash wall configuration. The mounting sleeves 30 can have a pair of spaced bores 160 with a pair of set screws 162, in order to secure abutting ends of rail tube sections within a single mounting sleeve.

The various components of the backsplash system can be formed from any rigid material, although steel having a chrome plated finish is preferred. The ends of the rail tube sections which are exposed can be closed by either having end caps or end plugs. Here again, the end caps or plugs can be made of the same material as the rail tube sections, and can have the same finish, such as chrome plating.

Having the angled faces on the rail tube sections provides for the rigidity of the various members suspended from the rail tube. There is no free swinging of hooks, as occurs with the round rail tubes presently in use. Providing the square cross-section for the rail tubes results in having physical contact with three faces by the loops forming a part of the suspension hardware. This results in obtaining the desired rigidity at the minimum cost. Mounting the rail tubes with a corner of the square uppermost, thereby giving the diamond appearance, provides an attractive appearance for the system, and additionally, provides the easiest manner of sliding the various suspended items onto or removing them from the rail tubes. Additionally, having this configuration permits the positioning of the vertical support rods, such as rods 64 and 100, in close proximity and parallel to the backsplash wall, as is apparent from FIGS. 5 and 8.

Without further elaboration, the foregoing will so fully illustrate this invention that others may, by applying current or future knowledge, readily adapt the same for use under various conditions of service.

We claim:

1. A system adapted to support items normally used in the kitchen, said system being mountable on a generally vertically oriented surface, and comprising a rail having a longitudinal axis, means for mounting said rail on the generally vertically oriented surface, supporting means suspended from said rail in a vertical orientation immediately adjacent said vertically oriented surface and having an upper portion for placement about said rail, said rail comprising face means cooperating with said upper portion of said supporting means to prevent the rotation of said upper portion of the supporting means about said longitudinal axis of said rail, and said supporting means having holding means for holding an object thereon, said object holding means comprising a rack, said rack comprising means for enabling said rack to be mounted to said support means so as to be alternately positioned in either a horizontal orientation or an inclined orientation and being adapted to serve the function of being a cooling rack when it is suspended from said rail in said horizontal orientation and adapted to be a cookbook holder when it is suspended from said rail in said inclined orientation.

2. The system of claim 1 wherein said face means comprises a plurality of faces projecting angularly with respect to each other, and wherein said upper portion of said supporting means comprises a plurality of faces projecting at the same angle as at least two of the plurality of faces of said face means.

3. The system of claim 2 wherein said plurality of aces of said supporting comprises three faces, and all three of said faces of said supporting means contact all three of the faces of said face means of said rail when said supporting means is mounted on said rail.

4. The system of claim 2 wherein said rack supporting means comprises a pair of hooks formed on the bottom of each of said rods, said rack including a support rod releasably engagable in said hooks.

5. The system of claim 1 wherein said rack has a front lip and a rear lip, said front lip being shorter than said rear lip, said supporting means comprising a pair of spaced rods, each of said rods having said upper portion thereon for placement over said rail, said rods having means for supporting said rack, and said rods having inclined legs associated with said rack supporting means, whereby said rack is oriented horizontally when the longer of said lips is in contact with said legs, and whereby said rack is in an inclined orientation when the shorter of said lips is in contact with said inclined legs.

6. The system of claim 5 wherein said rack is adapted to be positioned into a substantially vertical orientation for storage, and whereupon the engagement of the upper portion of the supporting means with at least one of said lips maintains said rack in said substantially vertical orientation.

7. The system of claim 2 wherein said angle is approximately 90 degrees.

8. A rack adapted to be supported on a kitchen wall, and comprising supporting means and a shelf, said supporting means comprising a pair of spaced rods, each of said rods having first means for supporting said shelf, said shelf having a front lip and a rear lip, said front lip being shorter than said rear lip, and said rods having inclined legs associated with said first means, said first means for supporting said shelf additionally comprising second means for enabling said shelf to be moved to a first position wherein said shelf projects in a horizontal orientation when said rear lip is in contact with said inclined legs, said second means also enabling said shelf to be moved to a second position wherein said shelf projects in an inclined orientation when said front lip is in contact with said inclined legs.

9. The rack of claim 8 wherein said second means comprises a pair of hooks formed on the bottom of each of said rods, said shelf including a support rod releasably engaged in said hooks.

10. The rack of claim 8 wherein said shelf is adapted to be moved to a third position wherein it projects in a substantially vertical orientation, said shelf being maintained in said third position by the engagement of said rods with one of said lips.

* * * * *